US011215406B2

(12) United States Patent
Champneys

(10) Patent No.: US 11,215,406 B2
(45) Date of Patent: Jan. 4, 2022

(54) WASTE HEAT RECOVERY UNITS

(71) Applicant: Boustead International Heaters Limited, Burgess Hill (GB)

(72) Inventor: David Champneys, Burgess Hill (GB)

(73) Assignee: Boustead International Heaters Limited

( * ) Notice: Subject to any disclaimer, the term of this patent is extended or adjusted under 35 U.S.C. 154(b) by 261 days.

(21) Appl. No.: 16/248,982

(22) Filed: Jan. 16, 2019

(65) Prior Publication Data

US 2019/0145720 A1 May 16, 2019

Related U.S. Application Data

(62) Division of application No. 14/898,258, filed as application No. PCT/GB2014/050706 on Mar. 10, 2014, now abandoned.

(51) Int. Cl.
*F28F 13/06* (2006.01)
*F28D 21/00* (2006.01)

(52) U.S. Cl.
CPC ..... *F28F 13/06* (2013.01); *F28D 21/001* (2013.01); *F28D 21/0003* (2013.01); *F28F 2250/06* (2013.01)

(58) Field of Classification Search
CPC .... F28F 9/04; F28F 9/165; F28F 13/06; F28F 2235/00; F28F 2250/06; F28F 27/02; F28D 21/001; F28D 21/0003; F16K 1/205; F02C 6/18; F02G 5/02; F24F 13/1413; F24F 13/1426; B60H 2001/0015; B60H 2001/00164
USPC ..... 165/103, 901
See application file for complete search history.

(56) References Cited

U.S. PATENT DOCUMENTS 3,522,841 A * 8/1970 Papalexiou ..... F24F 11/75 165/103
4,164,976 A * 8/1979 Timmerman ..... F24F 13/04 137/601.08
4,284,132 A * 8/1981 Strand, Sr. ..... F24F 3/048 137/601.01

(Continued)

FOREIGN PATENT DOCUMENTS

DE 2733931 A1 * 2/1979 ..... F01D 25/30
DE 2733931 A1 2/1979

(Continued)

OTHER PUBLICATIONS

European Patent Office; International Search Report PCT GB 2014 050706 dated Nov. 19, 2014 (5 pages).

(Continued)

*Primary Examiner* — Len Tran
*Assistant Examiner* — Gustavo A Hincapie Serna
(74) *Attorney, Agent, or Firm* — Luedeka Neely Group, PC

(57) ABSTRACT

A waste heat recovery unit includes a duct for hot gas. The duct is divided into first, second and third adjacent and parallel channels each with an inlet and an outlet. A heat exchanger is located in each of the first and third channels. The second channel is located between the first and third channels and provides a bypass channel. A damper system is operable to selectively open and close the inlets of the three channels. This provides a more compact waste heat recovery unit configuration which is more straightforward to manufacture and maintain.

12 Claims, 4 Drawing Sheets

(56) References Cited

U.S. PATENT DOCUMENTS

| | | | | |
|---|---|---|---|---|
| 4,669,530 | A | 6/1987 | Warner | |
| 4,747,748 | A * | 5/1988 | Sahiberg | F01D 1/04 415/169.2 |
| 5,246,063 | A | 9/1993 | Fix et al. | |
| 5,279,358 | A * | 1/1994 | Hannis | F01D 17/105 137/862 |
| 5,735,680 | A | 4/1998 | Henkelmann | |
| 5,934,994 | A * | 8/1999 | Wylie | F24F 13/1486 454/333 |
| 6,340,002 | B1 | 1/2002 | Liebig | |
| 7,264,040 | B2 * | 9/2007 | Bush | B60H 1/18 165/103 |
| 7,845,338 | B2 * | 12/2010 | Smith | F02M 26/26 123/568.12 |
| 7,931,074 | B2 * | 4/2011 | Itou | F28F 27/02 165/202 |
| 8,266,900 | B2 * | 9/2012 | Shikazono | F28D 7/0041 60/320 |
| 8,517,084 | B2 | 8/2013 | Kaspersen et al. | |
| 8,746,327 | B2 | 6/2014 | Mooij | |
| 9,541,030 | B2 * | 1/2017 | Baruzzini | F02K 1/46 |
| 10,526,967 | B2 * | 1/2020 | Wickham | F28F 27/02 |
| 2005/0133202 | A1 | 6/2005 | Jorgensen et al. | |
| 2005/0144931 | A1 * | 7/2005 | Floyd | F02C 6/18 60/39.511 |
| 2006/0070618 | A1 * | 4/2006 | Schimmeyer | F24H 9/0026 126/307 A |
| 2010/0009620 | A1 * | 1/2010 | Kawato | B60H 1/00849 454/241 |
| 2011/0131961 | A1 * | 6/2011 | Lee | F28D 7/0025 60/320 |
| 2012/0000200 | A1 | 1/2012 | Freund et al. | |
| 2014/0076292 | A1 * | 3/2014 | Gaiser | F01N 3/043 123/568.12 |
| 2015/0069643 | A1 * | 3/2015 | Mockry | F28C 1/00 261/146 |
| 2015/0218997 | A1 * | 8/2015 | Kato | F28D 21/0003 165/103 |

FOREIGN PATENT DOCUMENTS

| | | | | |
|---|---|---|---|---|
| DE | 20106186 | U1 | 8/2001 | |
| DE | 102006037773 | A1 | 2/2008 | |
| EP | 0493199 | A1 | 7/1992 | |
| EP | 0574645 | B1 | 1/1996 | |
| EP | 2208874 | A1 | 7/2010 | |
| GB | 2477316 | A | 8/2011 | |
| JP | H09203468 | A | 8/1997 | |
| JP | 2006349228 | A | 12/2006 | |
| JP | 2010070082 | A * | 4/2010 | B60H 1/00064 |
| WO | 2007084011 | A1 | 7/2007 | |

OTHER PUBLICATIONS

Intellectual Property Office Patents Act 1977 Search Report under Section 17GB1311013.5 dated Jan. 27, 2014.

Intellectual Property Office; Patents Act 1977 Further Search Report Under Section 17GB1311013.5 dated Sep. 9, 2014 (3 pages).

* cited by examiner

WASTE HEAT RECOVERY UNITS

CROSS REFERENCE TO RELATED APPLICATIONS

This application is a divisional of co-pending U.S. application Ser. No. 14/898,258 (allowed).

FIELD

The present invention relates to waste heat recovery units (WHRUs).

BACKGROUND

Gas turbines are commonly used in oil and gas facilities, both onshore and offshore, to provide shaft power to drive compressors or other machinery and for power generation. The gas turbine exhaust consists of a large quantity of hot gas, typically in the range of 450-600° C. Such oil/gas facilities typically also require heat for other parts of the process. Therefore heat can be recovered from the gas turbine exhaust by means of a waste heat recovery unit, which is a heat exchanger using heat from the exhaust gasses to heat a stream of water, oil or other fluid.

A WHRU is essentially provided by a heat exchanger with an array of tubing through which a stream of fluid to be heated is circulated. Exhaust gases from the gas turbine are passed around the exterior of the tubing thereby transferring heat to the fluid stream within the tubing.

It is desirable to reduce the size and weight of WHRUs, especially for offshore applications. This can be achieved by maximising the heat transfer coefficients, thus minimising the size and weight of the tube bank. It is also desirable to recover the maximum possible amount of heat to reduce the need to satisfy additional heat requirements by burning fossil fuels.

SUMMARY

The disclosure relates to a waste heat recovery unit including a duct for hot gas, with the duct divided into first, second and third adjacent and parallel channels. Each channel has an inlet and an outlet. A heat exchanger is located in each of the first and third channels, the second channel being located between the first and third channels and providing a bypass channel, further including a damper system operable to selectively open and close the inlets of the first, second and third channels.

In this way, a more compact arrangement is provided which is easier to manufacture and maintain and requires a smaller space envelope.

Preferably, the damper system includes a plurality of rotatable blades mounted to walls dividing the duct into the first, second and third channels, and connected to a common actuator.

Preferably, this actuator is operable to rotate the blades simultaneously and in opposite directions, whereby the blades are rotated towards one another to close the inlet to the bypass channel and are rotated away from another to close the inlets to the heat exchanger channels.

Preferably, the cross section of each channel is substantially rectangular.

In one embodiment, each heat exchanger includes an array of tubing for circulating fluid to be heated. The tubing is supported by a support structure and extending across the respective heat exchanger channel. A portion of the array extends through the support structure such that a plurality of tubing portions are located outside the main flow channel. The tubing portions are arranged adjacent to and spaced from one another, and further including a plurality of baffles each located between adjacent tubing portions to at least partially fill the space in between them.

Preferably, the tubing has a portion of finned larger outer diameter extending across the duct and through the support structure, and a portion of smaller outer diameter located external to the support structure, such that a smaller spacing is provided between adjacent larger outer diameter tubing portions, and a larger spacing is provided between adjacent smaller outer diameter tubing portions, and wherein the baffles are provided in a larger spacing.

Each baffle may include a rigid plate within an outer insulating blanket. By way of example, the rigid plate may be formed of metal and the blanket of ceramic or body soluble fibres.

Preferably, the damper system includes a plurality of rotatable blades. Each blade includes an upstream plate spaced from a downstream plate, and means to supply pressurised gas into the spacing between the upstream and downstream plates. A plurality of apertures are formed in at least some of the downstream plates to allow leakage of pressurised gas.

In a second aspect, the present invention provides a heat exchanger for a waste heat recovery unit, including a duct defining a main flow channel for hot gas, an array of tubing supported by a support structure and extending across the duct for circulating fluid to be heated. Part of the array extends through the support structure such that a plurality of tubing portions are located outside the main flow channel, adjacent to and spaced from one another, and further having a plurality of baffles each located between adjacent tubing portions so as to at least partially fill the spacing between them.

In a third aspect, the present invention provides a waste heat recovery unit including at least one duct for directing hot gas to a heat exchanger unit and at least one bypass duct to bypass hot gas around the heat exchanger unit, and a damper system having a plurality of rotatable blades. Each blade includes an upstream plate spaced from a downstream plate, and means to supply pressurised gas into the spacing between the upstream and downstream plates. A plurality of apertures are formed in at least some of the downstream plates to allow leakage of pressurised gas into the or each heat exchanger duct.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
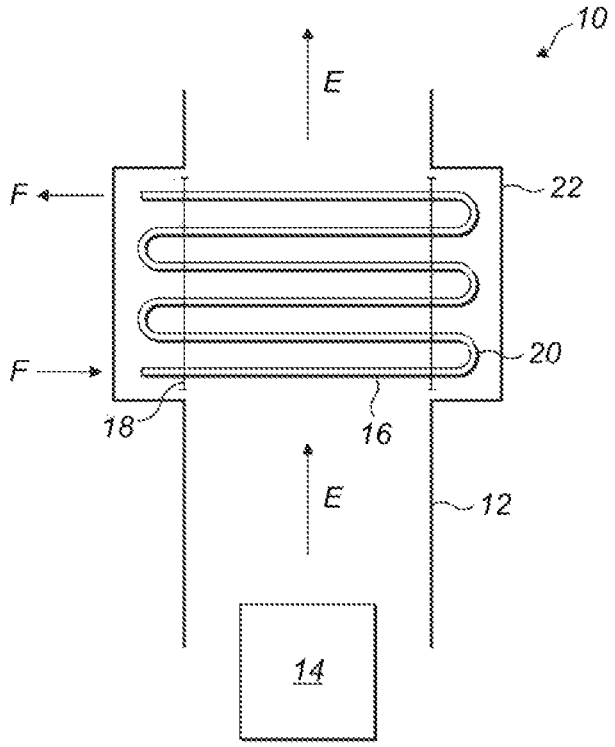
FIG. 1 is a schematic illustration of a conventional (prior art) waste heat recovery unit.

A typical conventional WHRU configuration is shown schematically in FIG. 1. The WHRU 10 includes a duct 12 for carrying hot exhaust gases (indicated by arrows E) from a gas turbine 14 to an array of heat exchanger tubing 16. For clarity, a single length of tubing 16 is shown. In practice, a plurality of such tubes are provided and may be referred to as a bundle or coil. As shown, the tubing 16 passes across the duct 12 multiple times with 180° turns at each side. The tubing 16 is supported on each side, and sometimes at intermediate points, by tube sheets 18. The 180° return bends 20 of the tubing 16 are located in header boxes 22 on the exterior side of the tube sheets 18, out of the main flow channel. The fluid to be heated is circulated through the tubing 16, usually in a counter current configuration, entering at the upper end of the WHRU 10 and exiting at the lower end as shown by the arrows F in FIG. 1.

In oil and gas facilities utilising WHRUs, the required amount of heat can vary with plant requirements and feed stock changes over the lifespan of the equipment. In addition, the flow and temperature of the hot gas from the gas turbine may vary with ambient conditions and machine loading. Current practice is to design the WHRU for the worst case combination of gas turbine exhaust conditions and heat demand. However, this means that for most of the time surplus heat is available. Current systems control this by bypassing a portion of the gas turbine exhaust flow around the heat exchange tubing array.

Figure 2:
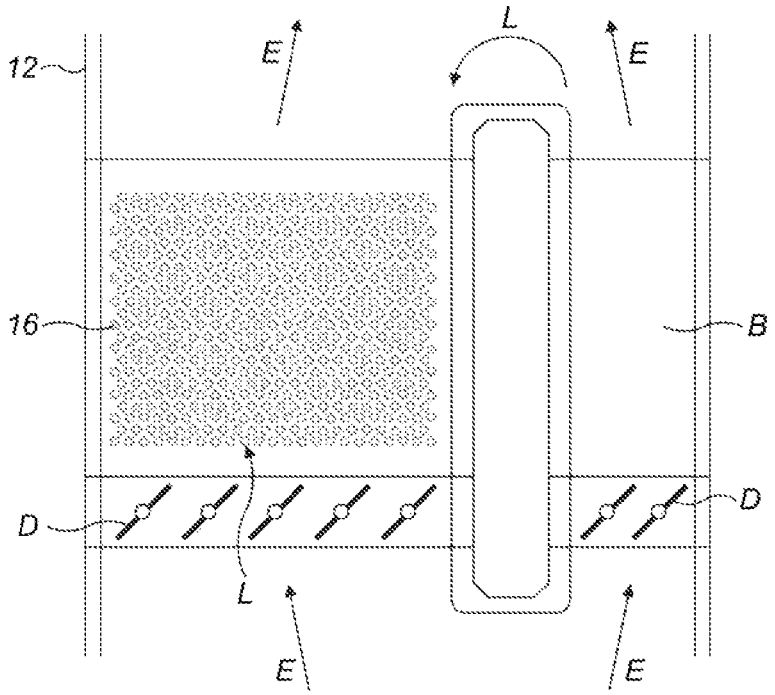
FIG. 2 is a schematic illustration of a conventional (prior art) WHRU with an integral bypass duct.

One popular configuration uses an integral bypass arrangement as shown schematically in FIG. 2. This arrangement consists of a bypass duct B in parallel with the duct 12 containing the heat exchanger tubing 16, creating two parallel streams for the exhaust gas. Each of the ducts 12, B is provided with a damper system D to selectively open and close the ducts. The damper systems are typically mechanically linked to each other so that as one opens the other closes. This enables the flow of hot gas to the tubing 16 to be controlled.

Figure 3:
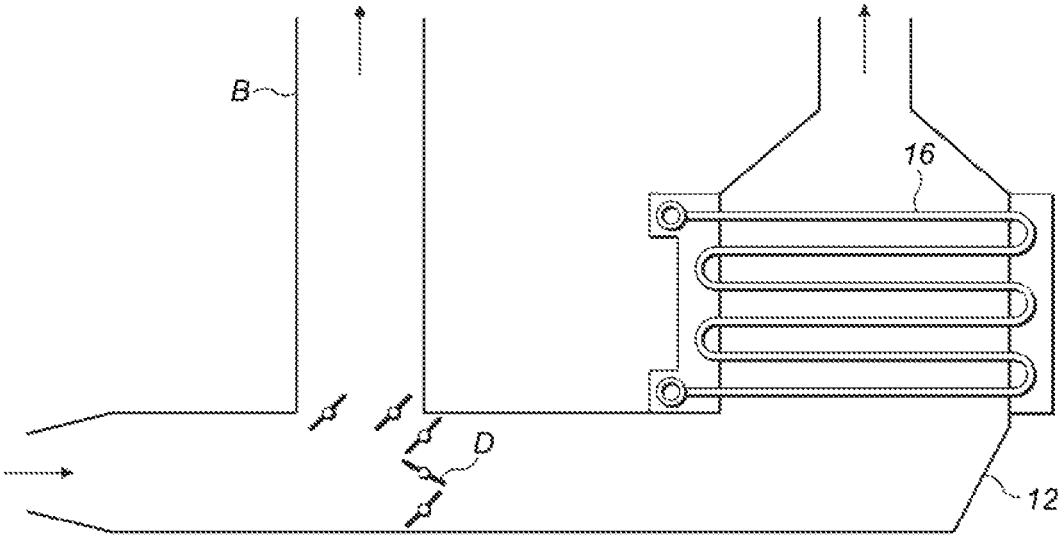
FIG. 3 is a schematic illustration of a conventional (prior art) WHRU with a separate bypass duct.

However, there are a number of disadvantages with this arrangement. It is necessary to have some space between the two parallel channels and this increases the overall space requirement for the unit. Indeed, in some configurations, as shown in FIG. 3, the bypass duct B is entirely separate and is set at a much greater distance from the duct 12 including the WHRU tubing 16, to avoid leakage of heat from the bypass duct to the tubing 16. However, this further increases the space requirement for the whole unit. In addition, the walls of the bypass duct B are typically made of steel and the weight of the unit is thus increased, which is disadvantageous in offshore of applications. The isolation damper for the WHRU section of the duct 12 is large and this adds to the overall cost of the unit. The tubing 16 of the WHRU is a single item of significant weight and this may even exceed crane capacity of the offshore facility.

Another solution is known as the "CIBAS" design. This uses a central bypass channel concentric with and surrounded by an annular heat exchange duct containing an annular array of tubing. This has some advantages over the system mentioned above in that there is no gap between the separate ducts for the heat exchange tubing and for the bypass flow and a large damper system is avoided.

However, this design also has major drawbacks. The tubes of the heat exchanger have to be bent into the annular configuration which adds to the cost of manufacture and creates integrity risks. The annular arrangement means that welds in the construction are not accessible and individual tubes cannot be removed for maintenance. In addition, the overall circular design does not take advantage of the corners of an available plot of space on a facility.

The present invention provides an alternative configuration in order to address these issues. As shown in FIG. 4 the WHRU 10 again includes a duct 12 for the flow of hot exhaust gas from the gas turbine. At the inlet to the WHRU section the duct 12 may be of circular cross section as shown, or rectangular or any other convenient shape, but the cross section of the WHRU itself is generally square or rectangular. Two dividing walls 40, 42 separate the duct 12 into three adjacent parallel channels 44, 46, 48 of generally rectangular or square cross section.

Figure 4:
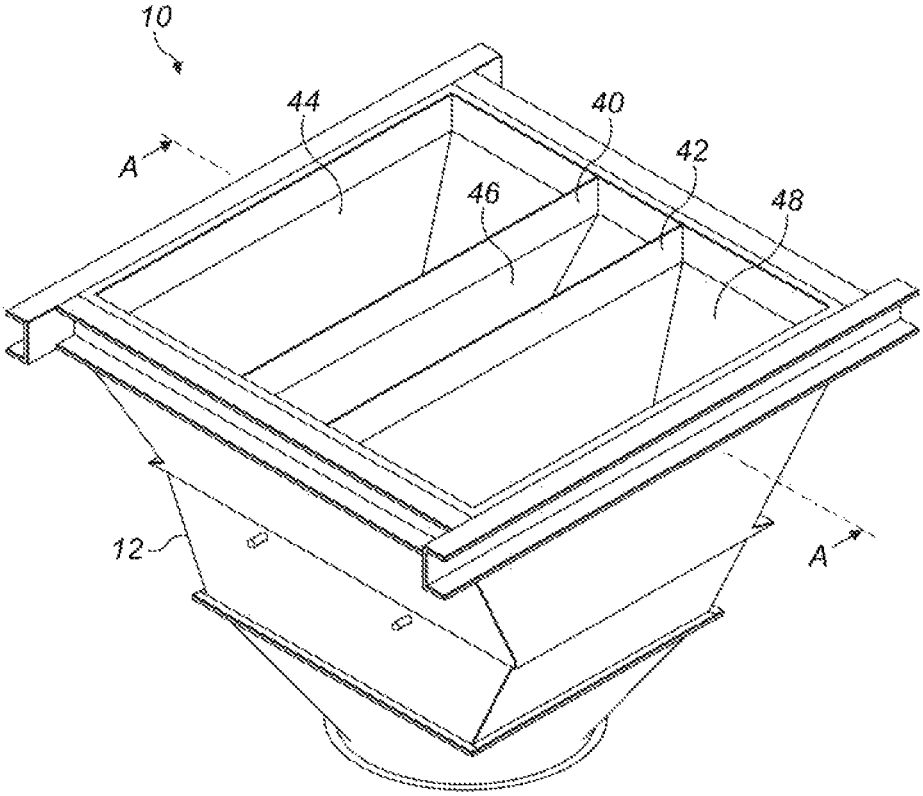
FIG. 4 is a schematic perspective view of a central bypass configuration WHRU in accordance with the present invention.

The outer channels 44, 48 each contain an array of heat exchange tubing although this is not shown in FIG. 4 for clarity. This may be arranged in any conventional manner. It may include the baffle plate system described further below.

The central channel 46 does not include any heat exchange tubing and provides a bypass duct.

Figure 5:
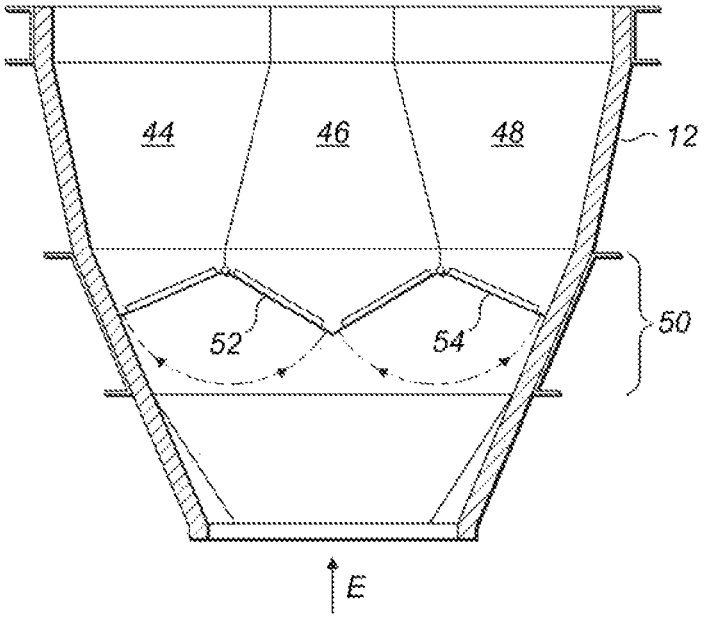
FIG. 5 is a cross section of FIG. 5 along the line A-A.

As shown in FIG. 5, a damper system 50 controls the flow of exhaust gas and determines which ducts it will pass through. The damper system 50 typically includes a pair of damper blades 52, 54 which are rotatably mounted at the lower extremity of the dividing walls 40, 42.

Preferably, rotation of the damper blades 52, 54 is controlled by a common actuator so that the blades 52, 54 will rotate in unison but in opposite directions. Thus, to pass hot gas through the two heat exchanger arrays in the outer channels 44, 48, one damper blade 52 is rotated anticlockwise and the other damper blade 54 is rotated clockwise so that they move towards each other and together they close the entrance to the bypass channel 46.

In order to close the heat exchanger channels 44, 48 the actuator rotates the damper blade 52 clockwise and the other damper blade 54 anticlockwise in order to open the bypass channel 46 and close the heat exchanger channels 44, 48. The damper blades 52, 54 may also be positioned at an intermediate point so that some flow passes through the heat exchanger channels 44, 48 and some through the bypass channel 46.

Thus, a WHRU including a bypass duct is provided in a compact arrangement which is more straightforward to manufacture and maintain and has a reduced space requirement than the previous configurations.

In the construction of a WHRU, whether of a conventional configuration or the central bypass configuration described above, the tubing 16 and tube sheets 18 require space to expand as they heat up in the flow of exhaust gas. Therefore, clearances must be left in the structure and it is not possible to completely seal all the gaps between the tubing 16 and the tube sheets 18. Consequently, some exhaust gases will escape through such gaps and bypass the main flow channel containing the majority of the array of tubing 16.

To compensate for the losses caused by such bypass flow, conventional systems may be made larger and heavier to maintain a desired heat transfer performance. However, this conflicts with the general desire to reduce size and weight of the WHRU.

Figure 6:
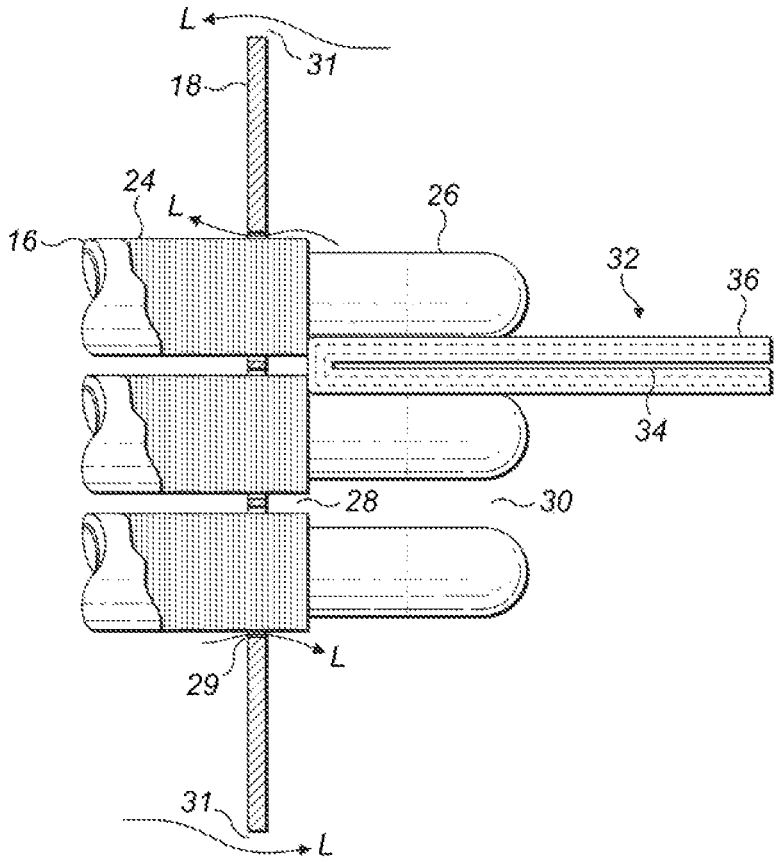
FIG. 6 is an enlarged detail view of a baffle plate system for use with the present invention.

In a further feature of the present invention a baffle system to restrict such bypass flow of hot gas may be provided. As shown in FIG. 6, the portion 24 of the tubing 16 within the main flow channel of the duct 20 and between the tube sheets 18 has an enlarged outer diameter and increased surface area. Typically this is created by forming a helical fin Which is welded to the exterior of the tubing 16 to provide a larger surface area for heat transfer. In a conventional system, the parts of the tubing 16 which are within the header box 22 and are external to the tube sheets 18 and the main flow channel, include some of the portion 24 with the fin, and also a reduced outer diameter portion 26, without the fin, for forming the return bends 20. Accordingly, a small gap 28 is left between adjacent parts of the larger diameter portion 24 of the tubing 16, where the fin is present. A larger gap 30 is left between adjacent parts of the smaller diameter portion 26 of the tubing 16, where no fin is present.

Furthermore, there is a gap 29 between the tube sheet 18 and the larger diameter portion 24 of the tubing 16 which includes the fin. This gap 29 is necessary for contraction and to allow for thermal expansion, but it creates a leakage path indicated by arrows L which can reduce the performance of the heat exchanger as hot gasses bypass the main flow channel and the main body of the tubing 16. In addition, the tube sheet 18 is normally not integral with the wall of the duct 12 and there are further gaps 31 around the edges of the tube sheet 18, creating a further leakage path also indicated by arrows L.

In the present invention baffle plates 32 are located in the larger gaps 30 between the smaller diameter portions 26 of the tubing 6 in the header box 22. Each baffle plate 32 consists of a rigid inner plate 34, for example a metal plate approximately 3 mm in thickness, which is encased in an insulating outer blanket 36, for example a ceramic fibre blanket approximately 25 mm thick. The baffle plates 32 block the larger gaps 30 so that the bypass flow of exhaust gas which has entered the header box 22 via gaps 29 and 31, can then only flow past the exterior of the larger diameter finned portion 24 of the tubing 16. Thus, although some bypass flow still occurs, this can be utilised for heat transfer into the fluid within the tubing 16 because it contacts the fin providing the larger surface area.

In this way the heat transfer performance of the WHRU 10 can be maintained despite the bypass flow and without increasing the size and weight of the unit. The baffle plates may be incorporated in a WHRU of conventional design, or the central bypass configuration described above.

A further issue which arises with WHRUs which include a bypass channel is that in order to run the gas turbine, a small flow of heat transfer medium must be maintained through the array of tubing 16 even if substantially all of the exhaust flow is passed through the bypass duct. This is because there may be some leakage of heat back to the heat exchange tubing from the outlet of the bypass flow channel, or heat leakage through the damper system. This heat leakage is indicated by arrows L in FIG. 2.

One existing solution is to have an entirely separate bypass duct widely spaced from the duct 12 containing the heat exchange tubing as in FIG. 5. However, this solution requires more space for the entire unit, adds weight and creates the need for an additional stack emission point.

Another known solution is to form the damper blades from two parallel plates with a spacing between them. Pressurised air is supplied into the spacing, which can exit at edges of the blade. Thus, an area of increased pressure is provided at the damper, which is a higher pressure that the flow of exhaust gas and serves to further seal the entrance to the WHRU.

However, this is not effective in preventing heat leakage occurring at the downstream end from the bypass duct outlet back to the heat exchanger outlet.

Figure 7:
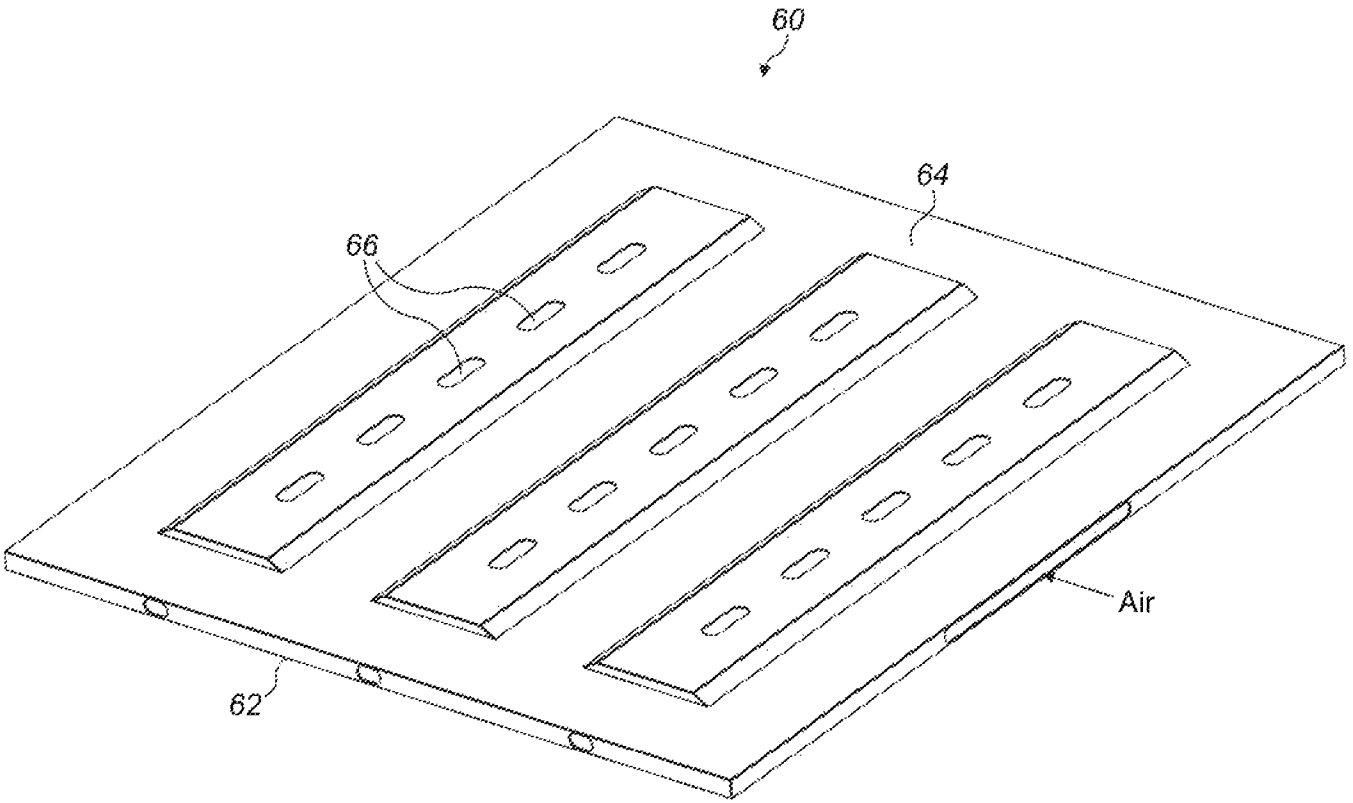
FIG. 7 is a schematic illustration of a WHRU damper blade for use with the present invention.

In FIG. 7, a damper blade 60 for addressing this problem is illustrated. The damper blade 60 includes a pair of spaced parallel plates 62, 64. In use, these are arranged with the plate 62 upstream and the plate 64 downstream. Thus, when the damper is closed, exhaust gasses will impinge on the upstream plate 62. A series of apertures 66 is provided in the downstream plate 64. This deliberately allows the pressurised seal air supplied to the interior spacing between the plates 62, 64 to leak out of the downstream plate 64 and into the flow channel of the WHRU.

In this way, the sealing effect is enhanced and the temperature of the heat exchange tubing 16 is kept below acceptable limits, even when there is no flow of heat transfer fluid in the tubing 16. This has the advantage of enabling the operator to start or continue to run the gas turbine even if the system which circulates the heat transfer fluid through the tubing 16 is out of service.

This arrangement of perforated damper plates may be incorporated in any conventional WHRU design, or used in conjunction with either or both the baffle plate system and the central bypass configuration as described above.

Thus, the present invention provides an improved waste heat recovery unit which is more efficient than conventional systems. The skilled person will appreciate that various modifications may be made to the precise details described above whilst not departing from the scope of the invention as set out in the following claims.

What is claimed:

1. A compact waste heat recovery unit configured to recover heat from exhaust gas of a gas turbine, the compact waste heat recovery unit comprising: a duct for exhaust gas having a high temperature, wherein the duct has a maximum of three adjacent channels provided by a first channel, second channel and a third channel, each of the first, second and third channels having an inlet and an outlet, the inlet of the first channel and the inlet of the third channel being smaller than the outlet of the first channel and the outlet of the third channel, and the inlet of the second channel being larger than the outlet of the second channel, a heat exchanger located in each of the first and third channels and configured to recover heat from the exhaust gas so that the temperature of the exhaust gas at the outlets of the first and third channels is lower than the temperature of the exhaust gas at the inlets of the first and third channels, and the second channel is located between the first and third channels and is without a heat exchanger and provides a single bypass channel for direct travel of the exhaust gas through the second channel to avoid contact of the hot exhaust gas with the heat exchanger located in the first channel and the heat exchanger located in the third channel to control absorbance of heat from the exhaust gas by the heat exchangers located in the first and third channels, and dampers operable to selectively open and close the inlets of the first, second and third channels, the dampers comprising a plurality of rotatable blades mounted to walls dividing the duct into the first, second and third channels, and connected to a common actuator.

2. The waste heat recovery unit as claimed in claim 1, wherein the actuator is operable to rotate the blades simultaneously and in opposite directions, whereby the blades are rotated towards one another to close the inlet to the bypass channel and are rotated away from one another to close the inlets to the heat exchanger channels.

3. The waste heat recovery unit as claimed in claim 1, wherein the cross-section of each channel is substantially rectangular.

4. The waste heat recovery unit as claimed in claim 2, wherein the cross-section of each channel is substantially rectangular.

5. The waste heat recovery unit as claimed in claim 1, wherein each heat exchanger comprises an array of tubing for circulating fluid to be heated, the tubing supported by a support structure and extending across the respective heat exchanger channel, wherein a portion of the array extends through the support structure such that a plurality of tubing portions are located outside a main flow channel, the tubing portions arranged adjacent to and spaced from one another, and further comprising a plurality of baffles each located between adjacent tubing portions to at least partially fill the spacing therebetween.

6. The waste heat recovery unit as claimed in claim 5, wherein the tubing comprises a portion of larger outer diameter extending across the duct and through the support structure, and a portion of smaller outer diameter located external to the support structure, such that a smaller spacing is provided between adjacent larger outer diameter tubing portions, and a larger spacing is provided between adjacent smaller outer diameter tubing portions, and wherein the baffles are provided in the larger spacings.

7. The waste heat recovery unit as claimed in claim 5, wherein each baffle comprises a rigid plate within an outer insulating blanket.

8. The waste heat recovery unit as claimed in claim 7, wherein the rigid plate is formed of metal and the blanket is formed of ceramic fibres.

9. The waste heat recovery unit as claimed in claim 6, wherein each baffle comprises a rigid plate within an outer insulating blanket.

10. The waste heat recovery unit as claimed in claim 8, wherein the rigid plate is formed of metal and the blanket is formed of ceramic fibres.

11. The waste heat recovery unit as claimed in claim 1, wherein each of the rotatable blades comprises an upstream plate spaced from a downstream plate, and pressurised gas is supplied into the spacing between the upstream and downstream plates, wherein a plurality of apertures are formed in at least some of the downstream plates to allow leakage of pressurised gas into each heat exchanger duct.

12. The waste heat recovery unit as claimed in claim 9, wherein each heat exchanger comprises a heat exchanger duct defining a main flow channel for hot gas, an array of tubing supported by a support structure and extending across the heat exchanger duct for circulating fluid to be heated, wherein part of the array extends through the support structure such that a plurality of tubing portions are located outside the main flow channel, adjacent to and spaced from one another, and further comprising a plurality of baffles each located between adjacent tubing portions to at least partially fill the spacing therebetween.

* * * * *